US011020960B2

(12) United States Patent
Martin et al.

(10) Patent No.: US 11,020,960 B2
(45) Date of Patent: Jun. 1, 2021

(54) FAULT TOLERANT PRINTHEAD

(71) Applicant: Hewlett-Packard Development Company, L.P., Spring, TX (US)

(72) Inventors: Eric Martin, Corvallis, OR (US); Daryl E. Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/615,191

(22) PCT Filed: Jun. 30, 2017

(86) PCT No.: PCT/US2017/040187
§ 371 (c)(1),
(2) Date: Nov. 20, 2019

(87) PCT Pub. No.: WO2019/005091
PCT Pub. Date: Jan. 3, 2019

(65) Prior Publication Data

US 2020/0171814 A1 Jun. 4, 2020

(51) Int. Cl.

| | |
|---|---|
| ***B41J 2/045*** | (2006.01) |
| ***B41J 2/165*** | (2006.01) |
| *B41J 2/14* | (2006.01) |

(52) U.S. Cl.
CPC ..... *B41J 2/0451* (2013.01); *B41J 2/04541* (2013.01); *B41J 2/04585* (2013.01); *B41J 2/16579* (2013.01); *B41J 2/0458* (2013.01); *B41J 2/04543* (2013.01); *B41J 2/04581* (2013.01); *B41J 2/16517* (2013.01); *B41J 2002/14354* (2013.01)

(58) Field of Classification Search
CPC ..... B41J 2/0451; B41J 2/04585; B41J 2002/14354; B41J 2/04541; B41J 2/04543; B41J 2/0458; B41J 2/04581; B41J 2/16579; B41J 2/16517
See application file for complete search history.

(56) References Cited

U.S. PATENT DOCUMENTS

| | | | |
|---|---|---|---|
| 6,260,941 | B1 | 7/2001 | Su et al. |
| 7,585,038 | B2 | 9/2009 | Shibata et al. |
| 7,669,952 | B2 | 3/2010 | Silverbrook |

(Continued)

FOREIGN PATENT DOCUMENTS

| | | |
|---|---|---|
| CN | 1891462 | 1/2007 |
| EP | 1900530 A2 | 3/2008 |

(Continued)

OTHER PUBLICATIONS

HP Designjet 5000 and 5500 Series Printers—Troubleshooting the Ink System ~~ http://h20564.www2.hp.com/ ~ Apr. 18, 2017 ~ 8 pages.

*Primary Examiner* — Yaovi M Ameh
(74) *Attorney, Agent, or Firm* — HP Inc. Patent Department

(57) ABSTRACT

In one example, a fault-tolerant printhead includes an array of fluid actuators. Each fluid actuator includes a fault sensor to detect a faulted fluid actuator and a per-fluid actuator memory to store a fault sensor state of the fluid actuator. The fault-tolerant printhead also includes an interface to read a state of each per-fluid actuator memory.

6 Claims, 10 Drawing Sheets

(56) References Cited

U.S. PATENT DOCUMENTS

| | | | | |
|---|---|---|---|---|
| 7,748,807 | B2 | 7/2010 | Jones et al. | |
| 9,022,499 | B2 | 5/2015 | Fujimoto | |
| 9,056,512 | B1 | 6/2015 | Kanzaki | |
| 2002/0030707 | A1 | 3/2002 | Arnold et al. | |
| 2006/0170744 | A1 | 8/2006 | Boesten et al. | |
| 2006/0244777 | A1 | 11/2006 | Paasch | |
| 2007/0002088 | A1* | 1/2007 | Jeong | B41J 29/38 347/12 |
| 2011/0242162 | A1* | 10/2011 | Tamura | B41J 29/38 347/9 |
| 2013/0278657 | A1 | 10/2013 | Martin et al. | |
| 2014/0009529 | A1* | 1/2014 | Teshigawara | B41J 2/16517 347/23 |
| 2016/0229178 | A1* | 8/2016 | Fukazawa | B41J 2/2132 |
| 2016/0339695 | A1 | 11/2016 | Chen et al. | |

FOREIGN PATENT DOCUMENTS

| | | | |
|---|---|---|---|
| WO | WO-2016137501 | A1 | 9/2016 |
| WO | WO-2016175853 | A1 | 11/2016 |

* cited by examiner

FAULT TOLERANT PRINTHEAD

BACKGROUND

Fluid jet printheads are now being used in printer device applications that use expensive media and create high-quality output. The fluid jet printheads are also used in other devices to transfer fluids such as in drug delivery, micro-assays, and the like. For instance, any errors created during printing may cause undue waste and lost time for calibration, repair, and/or resetting of a print job. Printer devices may produce text and images on media through drop-on-demand ejection of fluid drops using "inkjet fluid actuators." In this disclosure, however, "fluid actuators" or "actuators" include both ejecting fluid nozzles and orifices as well as non-ejecting actuators such as used in microfluidic pumps in both printers and other devices. When any of these fluid actuators become clogged or otherwise fail, the fluid actuators can stop operating correctly. In the case of inkjet fluid actuators with ejecting fluid nozzles, these failures may cause visible print defects in the printed output. Such print defects are commonly referred to as "missing fluid actuator" print defects caused by "faulted fluid actuators."

BRIEF DESCRIPTION OF THE DRAWINGS

The disclosure is better understood with reference to the following drawings. The elements of the drawings are not necessarily to scale relative to each other. Rather, the emphasis has instead been placed upon clearly illustrating the claimed subject matter. Furthermore, like reference numerals designate corresponding similar parts through the several views.

DETAILED DESCRIPTION

For conciseness and definiteness, the following description is directed in terms of one or more fluid inkjet fault-tolerant printheads each having multiple fluid actuators. However, the claimed subject matter is applicable to many other types of printing elements, printheads, and fluidic control devices such as wax-based, piezo-electric, tissue ejectors, 3D printers, biological scaffolding, binders, assay devices, coaters, etc. Accordingly, the claimed subject matter is not necessarily limited to printers that dispense ink as such but is applicable to many other devices that manipulate fluids in the forms of colorant, chemicals, medicines, materials, and biological fluids. Moreover, the claimed subject matter is not necessarily limited to printing on ordinary printing media such as paper, plastic sheeting, and the like but rather may be used in devices that can perform incremental printing or fluid placement and movement on virtually any medium including clothing, cloth, food, wood, metal, glass, plastics, ceramics, billboards, etc.

Figure 1A:
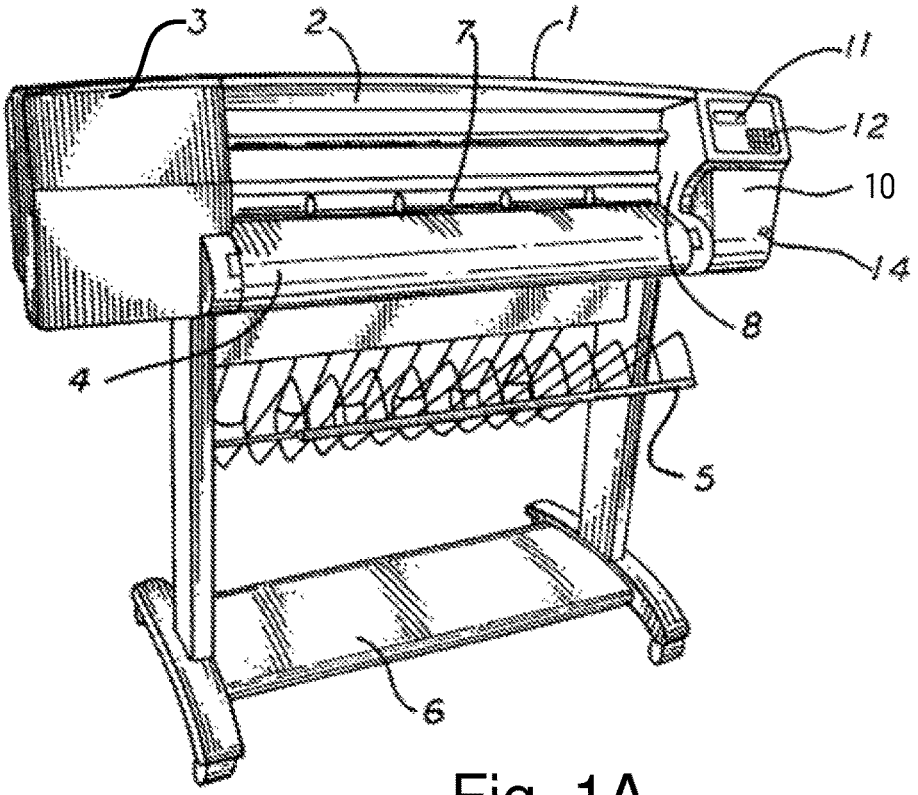
FIG. 1A is an illustration of an example printer device for use with a fault-tolerant printhead.

FIG. 1A is an illustration of an example printer device 1 for use with at least one fault-tolerant printhead 30 (FIG. 1B) in large format printing although the claimed subject matter may also be used with small, personal, intermediate, and large scale printer devices and plotters as well. Such additional printer devices may include desktop printers, portable printers, hand-held printers, bar-code printers, heat-transfer printing, fax machines, thermal printers, ATM-machine receipt printers as just a few examples. Those skilled in the art will understand how to interpret the following discussion and associated drawings with respect to these many other types of printing devices and printed products.

Figure 1B:
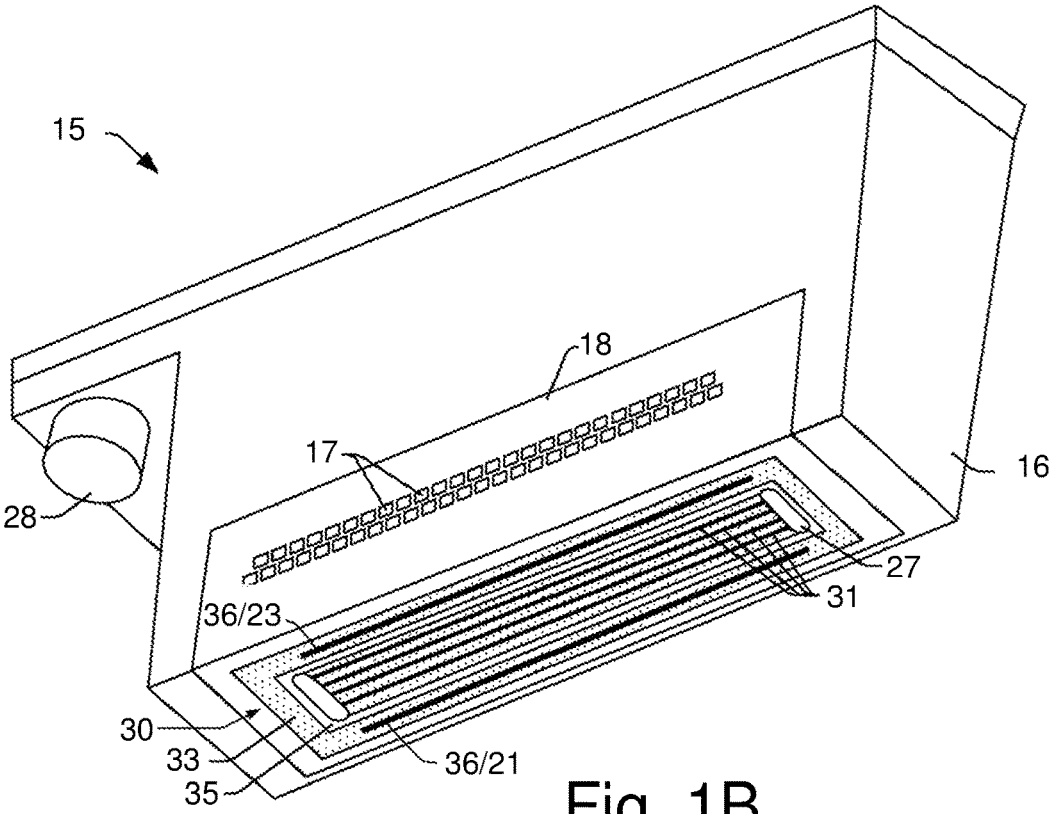
FIG. 1B is an example print cartridge for the printer device of FIG. 1A that includes at least one example fault-tolerant printhead.

Printer device 1 may include a chassis 2 with a left-hand pod 3 that encloses one end of the chassis 2. Within the printer device 1 may be a carriage support for printhead assemblies 15 (FIG. 1B) and drive mechanisms including a print medium advance mechanism. Other items may include a pen refill station with supplemental ink cartridges and/or a service station for servicing the printhead assemblies 15 having fault-tolerant printheads 30 (FIG. 1B). In this example printer device 1 provides a print media 4 and a receiving bin 5 for lengths or sheets of print media 4 on which images have been formed and ejected from the printer device 1. Just above the print media 4 is an entry slot 7 for receipt of fixed or continuous lengths of print media 4. A right-hand pod 8 on chassis 2 may include a display 11, controls 12, a printer controller 10 within, and power switch 14. A storage shelf 6 spans the legs which support the left-hand pod 3 and right-hand pod 8 of printer device 1.

In printer devices 1 that employ multi-pass print modes (e.g., scanning a print cartridge back and forth across the print media 4), missing fluid actuator defects have been addressed by passing an inkjet printhead over the same section of the print media 4 multiple times. This multi-pass print mode provides an opportunity for several fluid actuators to jet ink or other fluid onto the same portion of the medium to minimize the effect of one or more missing fluid actuators though at a cost of reduced print throughput. Another way used to address missing fluid actuator print defects was through speculative fluid actuator servicing. In this approach, a printer device 1 caused a printhead to eject ink into a service station to exercise fluid actuators and perhaps thus ensure their future functionality, regardless of whether the fluid actuators would have produced a print defect. This approach may have wasted valuable ink and may also have added throughput delay due to long service times.

In printer devices 1 that employ single-pass print modes (e.g., print media 4 passing one time under a printhead array of fluid actuators), missing fluid actuator defects have been addressed using redundant printhead fluid actuators that can mark the same area of the print media 4 as where a defective fluid actuator would have marked, or by servicing the defective fluid actuator to restore it to full functionality. Multiple fluid actuators, however, added additional cost and overhead. However, the success of these solutions, particularly in the single-pass print modes, relied on a timely but lengthy identification of the missing or defective fluid actuators, such as by scanning the printed output to look for flaws in the printing.

FIG. 1B is an example printhead assembly 15 for the printer device 1 of FIG. 1A including at least one example fault-tolerant printhead 30. In this example, printhead assembly 15 includes a molded fault-tolerant printhead 30 with four individual printhead dies 31 and a fluid actuator fault sensor 36 that is optically-based and molded into a molding 33 and supported by a cartridge housing 16. In this example, the fluid actuator fault sensor 36 is combined with the fault-tolerant printhead 30 to detect missing drops of fluid from individual fluid actuators 38 (see FIGS. 2-6). In this example, components of an optical-based fluid actuator fault sensor 36 may be individually fluid actuator location based and in aggregate create an illumination array 21 and a detection array 23. In another example, a fault sensor 36 is fabricated on-die and included within the printhead dies 31 at each fluid actuator location such as with piezo-electric or resistance stress sensing and/or resistor short/open sensing. In other examples, the fault sensor 36 may reside at one or more common or central locations on the printhead dies 31 but still able to test each fluid actuator location, such as detecting for fluid actuator resistor shorts to conductive backplanes that span multiple fluid actuators. Many options for creating fluid actuator fault sensors 36 that can test and evaluate the health of individual fluid actuators 38 exist and are known to those of skill in the art.

In this example, printhead 30 may include four elongated printhead dies 31 (such as for Black, Cyan, Magenta, and Yellow ink fluids) and a printed circuit board (PCB) 35 embedded into the molding 33. In other examples, printhead 30 may consist of 1 or more printhead dies 31, each die 31 consisting of one or more fluid-feed slots arrays. In the example shown, the printhead dies 31 are arranged parallel to one another across the width of printhead 30, within a window that has been cut out of the PCB 35. While the illustrated printhead assembly 15 has a single printhead 30 with four dies 31, other configurations are possible, such as printhead assemblies 15 having multiple fault-tolerant printheads 30, each with more or less dies 31 or multiple cartridges with fault-tolerant printheads 30 each with one or more dies 31. At either end of the printhead dies 31 there may be bond wires (not shown) covered by low profile protective coverings 27 of a suitable protective material such as an epoxy, and a flat cap may be placed over the protective material for further moisture and other chemical abatements. In other examples, the printhead dies 31 may be coupled to the PCB 35 using flip-chip technology.

Printhead assembly 15 may have a self-contained fluid supply or it may have a small reservoir for pressure stabilization and be fluidically connected to one or more fluid supplies in the printer device 1 through one or more fluid ports 28. Printhead assembly 15 may be electrically connected to the printer controller 10 through electrical contacts 17. Contacts 17 may be formed in a flex circuit 18 affixed to the cartridge housing 16. Signal traces (not shown) embedded in flex circuit 18 may connect contacts 17 to corresponding contacts (not shown) on printhead 30. Fluid ejection individual fluid actuators may be arranged in an array of fluid actuators 34 on each printhead die 31 and may be exposed through an opening in flex circuit 18 along the bottom of cartridge housing 16.

Figure 2:
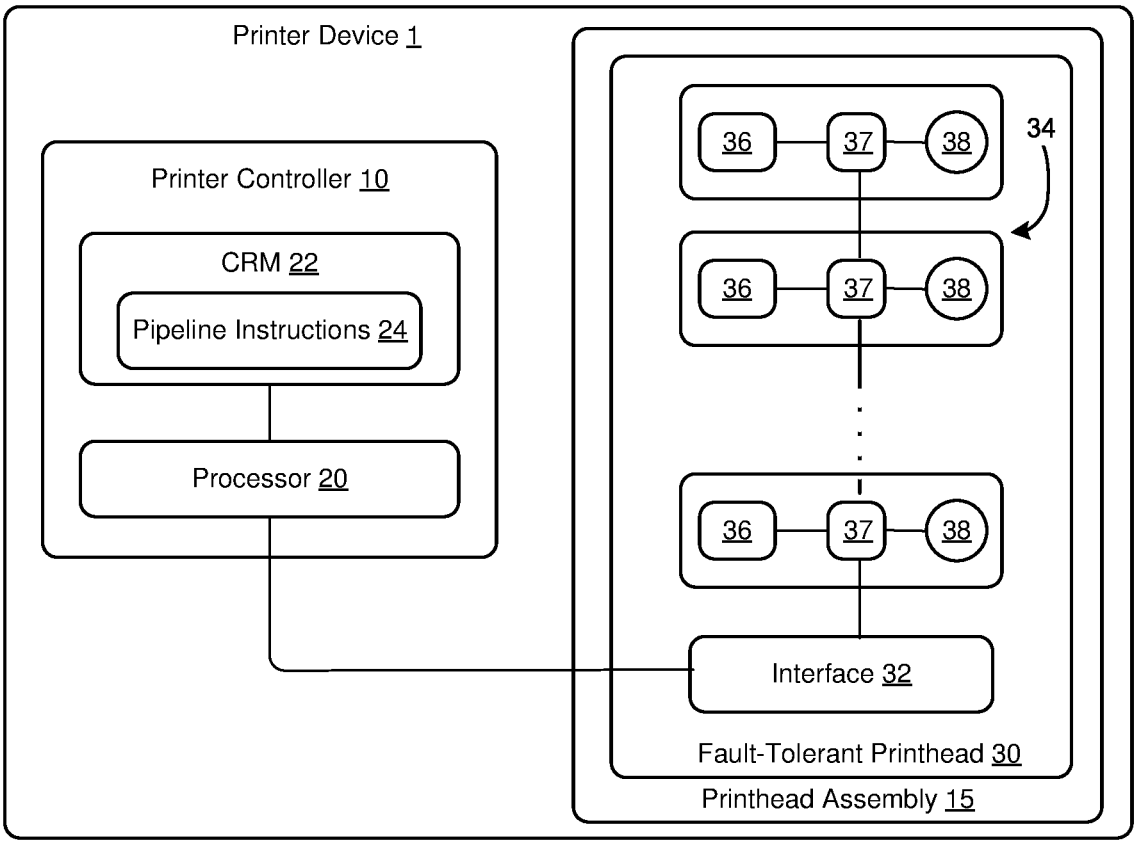
FIG. 2 is a partial schematic drawing of the example printer device in FIG. 1A with use of a fault-tolerant printhead in a print cartridge.

FIG. 2 is a partial schematic drawing of the example printer device 1 of FIG. 1A with the use of an example fault-tolerant printhead 30 in printhead assembly 15. The printer device 1 may have one or more printhead assemblies 15 that each have one or more fault-tolerant printheads 30 supporting one or more colors, binders, coatings, etc. The printer controller 10 includes a processor 20 coupled to a tangible non-transitory machine or computer readable medium (CRM) 22 that includes instructions that when read and executed by the processor 20 cause the processor to execute one or more pipeline instructions 24 for an image pipeline module in printer device 1. The pipeline instructions 24 may include instructions that read the sensed state of the individual fluid actuators 38 of the fault-tolerant printhead 30 and these instructions may stop printing and/or modify the image pipeline print data that is written to the fault-tolerant printhead 30 during printing.

The fault-tolerant printhead 30 architecture of this disclosure may include individual or integrated fluid actuator fault sensors 36 or each individual fluid actuator 38 may receive individual fluid actuator fault sensor results from a group (such as a primitive) based fault sensor to detect one or more faults of individual fluid actuators 38 in an array of fluid actuators 34. The detected faults may be one of many types, such as resistor shorts, fluid actuator voids, clogged fluid actuators, etc. A binary or multi-bit state of the fluid actuator fault is stored per fluid actuator in per-fluid actuator memory 37 and can be read by the printer controller 10 at an opportune time, such as at the end of a print job, between print jobs, or between pages, however, other times during printing of a print job are possible.

For instance, in continuous feed industrial presses, "between jobs" or "between pages" may mean between print jobs that are printed on the same continuous roll of continuously moving print media 4. Accordingly, "after print job completion" or "completion of a print job" may mean after a page or portion of a printed medium 4 has completed and ejected from the printer device 1 or after an image or other graphic has been sent and printed on the print media 4 before an additional image or another graphic is sent to printer device 1. Further, the terms may also encompass the end of one pass of the fault-tolerant printhead 30. The printer controller 10 can use the read fluid actuator state information using a memory interface 32 coupled to the processor 20 from per-fluid actuator memory 37 to adjust an image pipeline module in a print formatting module to mitigate the effects of using any individual fluid actuators 38 with faults. In one example, until the printer device 1 can read the fluid actuator state information, the fault-tolerant printhead 30 may autonomously re-assign print data to a nearest adjacent functional fluid actuator 38 for a mid-page/mid-print job immediate response to faulted fluid actuators in the array of fluid actuators 34 until the printer controller 10 can update an image pipeline module to allow for a more flexible and possibly higher quality upstream software-based image pipeline response for fluid actuator replacement.

Accordingly, a printer device 1 may have a computer readable medium (CRM) 22 with pipeline instructions 24 in one or more modules to create an image pipeline of print data for individual fluid actuator firings. A processor 20 is coupled to the CRM 22 to execute the pipeline instructions 24. The printer device 1 also may include a fault-tolerant printhead 30 that includes an array of fluid actuators 34, each fluid actuator 38 including a fault sensor 36 or receiving individual fault sensor data to detect a respective fluid actuator 38 having a fault. Each individual fluid actuator has associated with it a per-fluid actuator memory 37 to store a fault sensor state of the respective fluid actuator. Various fluid actuator faults that may be detected include resistor failures (shorts, opens, value changes, leakage, etc.), clogged or coagulated fluid actuators, voided or decapped fluid actuators, particle contamination, etc. as just some examples, as more are known to those of skill in the art. Implementation of the fault sensor 36 may include optical sensing, drive bubble detection, resistor shorts to a conductive plate sense, strain gauge-based measurements and the like. While printing, the fault sensor 36 monitors and tests fluid actuators using one or more tests to validate the functionality of each fluid actuator.

The per-fluid actuator memory 37 may be a binary, tertiary, or other multi-bit representation of the fault sensor state. For instance, in one example, a "0" may mean the individual fluid actuator 38 is operating normally and a "1" may mean that the individual fluid actuator 38 is in a faulted state. A multi-bit fault sensor state may encode one or more different states of a fluid actuator, whether faulted or not and such states may include both faulted states and non-faulted states. For instance, the multi-bit fault sensor may indicate that there is not a resistor short, or not clogged, or that the fluid actuator is decapped, thus indicating it may be repaired by servicing but currently not fully unusable. The fault-tolerant printhead 30 may further include a memory interface 32 coupled to the processor 20 to read the state of each per-fluid actuator memory 37. The pipeline instructions 24 may modify an image pipeline module to mitigate the effects of any fluid actuators 38 with faults. For instance, the pipeline instructions 24 may avoid the use of the fluid actuator or it may continue use of the fluid actuator in addition to the concurrent use of other fluid actuators to create the print data assigned to the respective faulted fluid actuator 38.

The various examples described within this disclosure may include logic or a number of components, modules, or constituents. Modules may constitute either software modules, such as code embedded in tangible non-transitory machine or computer readable medium (CRM) 22 or hardware modules. A hardware module may be a tangible unit capable of performing certain operations and may be configured or arranged in certain manners. In one example, one or more computer systems or one or more hardware modules of a computer system may be configured by software (e.g. an application, or portion of an application) as a hardware module that operates to perform certain operations as described herein.

In some examples, a hardware module may be implemented as electronically programmable. For instance, a hardware module may include dedicated circuitry or logic that is permanently configured (e.g. as a special-purpose processor, state machine, a field programmable gate array (FPGA) or an application-specific integrated circuit (ASIC) to perform certain operations. A hardware module may also include programmable logic or circuitry (e.g. as encompassed within a general-purpose processor 20 or other programmable processors) that is temporarily configured by software to perform certain operations. It will be appreciated that the decision to implement a hardware module electronically in dedicated and permanently configured circuitry, or in temporarily configured circuitry (e.g. configured by software) may be driven by cost and time considerations.

The computer readable medium 22 allows for storage of one or more sets of data structures and instructions (e.g. software, firmware, logic) embodying or utilized by any one or more of the methodologies or functions described herein, such as pipeline instructions 24. The instructions may also reside, completely or at least partially, with the static memory, the main memory, and/or within the processor 22 during execution by the printer controller 10. The main memory and the processor memory of printer controller 10 also constitute computer-readable medium 22. The term "computer-readable medium" 22 may include single medium or multiple media (centralized or distributed) that store the one or more instructions or data structures. The computer readable medium 22 may be implemented to include, but not limited to, solid state, optical, and magnetic media whether volatile or non-volatile. Such examples include, semiconductor memory devices (e.g. Erasable Programmable Read-Only Memory (EPROM), Electrically Erasable Programmable Read-only Memory (EEPROM), and flash memory devices), magnetic discs such as internal hard drives and removable disks, magneto-optical disks, and CD-ROM (Compact Disc Read-Only Memory) and DVD (Digital Versatile Disc) disks, as just some examples.

Figure 3:
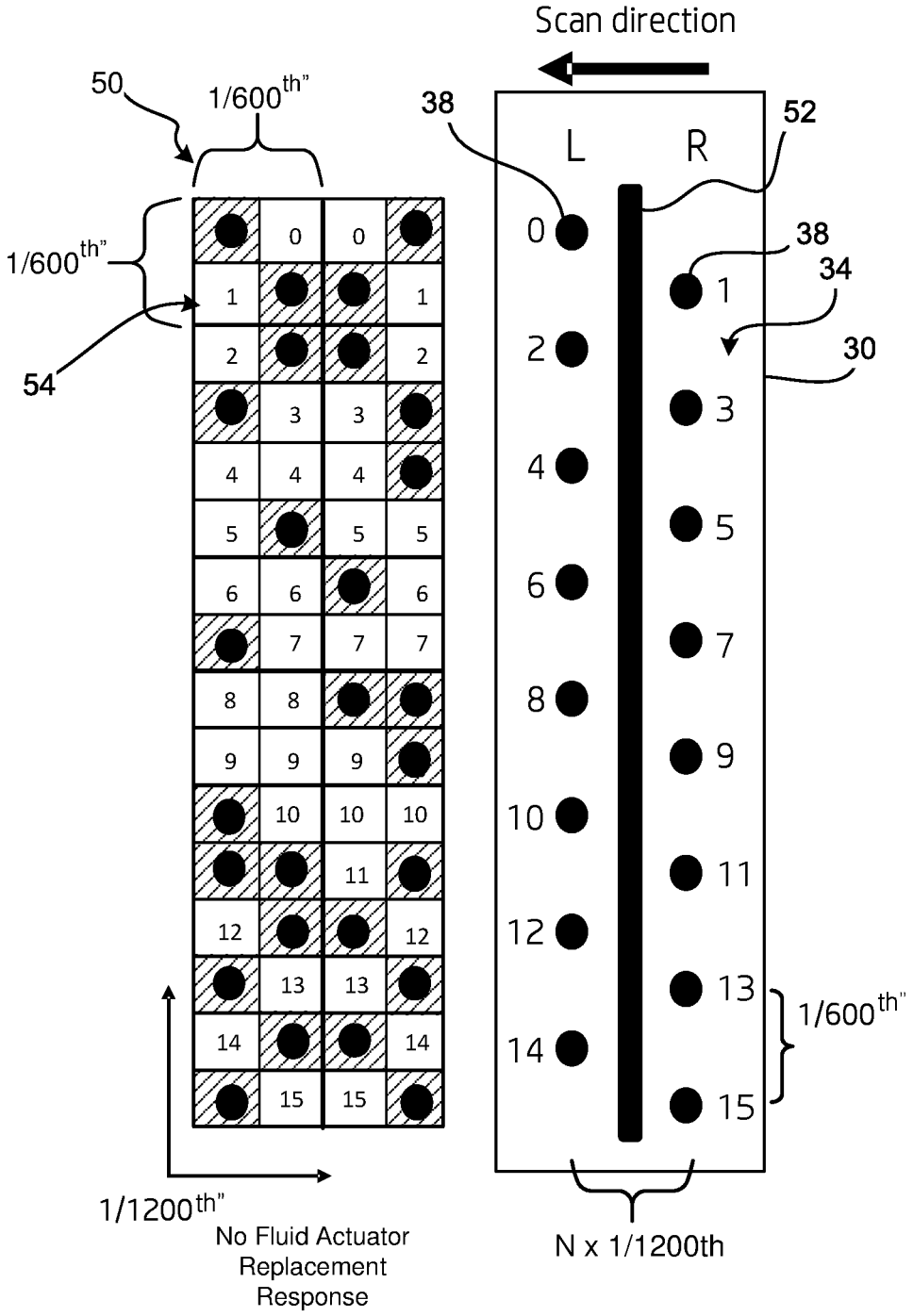
FIG. 3 is an illustration of an example print operation for a fully functional fault-tolerant printhead.

FIG. 3 is an illustration of an example first print operation 50 of print data for a fully functional fault-tolerant printhead 30 having a center fluid-feed slot 52 and an array of fluid actuators 34 formed in two staggered columns of even numbered individual fluid actuators 38 on the left side of the center fluid-feed slot 52 and odd numbered individual fluid actuators 38 on the right. In this example, assume a print job where the desired output is to be printed at 600 pixels per inch (PPI) (but could be any desired separation) with 4 opportunities for dots per each 600 PPI pixel 54 that is a 2×2 array of 1200th pixels, and allowance for placing 0 to 4 drops in each of the four 1200th pixel rows numbered 0-15 of each 600 PPI pixel 54. The vertical spacing of the individual fluid actuators 38 in each column is thus $1/600^{th}$ of an inch and the offset between individual fluid actuators 38 in the two columns is $1/1200^{th}$ of an inch. An actuation event can occur as the fault-tolerant printhead 30 is scanned every $1/1200^{th}$ of an inch based on print data. Note that the two columns are in this example spaced an integer "N"×$1/1200^{th}$ apart to span the center fluid-feed slot 52, such as N=6 or $6/1200^{th}$ of an inch in one example. The printhead fluid actuators 34 may then scan a print medium 4 from right to left to create the print operation 50 shown. The left "L" fluid actuators 38 may be used to populate even dot rows on print operation 50 and right "R" fluid actuators 38 may be used to populate odd dot rows on print operation 50. Therefore, as there are four columns in the first print operation 50, each of the "L" and "R" fluid actuators may have to actuate between 0 and 16 (4 rows by up to 4 drops/row) drops per scan. In this example, the desired printing locations in first print operation 50 are shown by a diagonal hashed shading at each desired print data location and just one drop used per each desired location when all "L" and "R" fluid actuators are operational and able to actuate. Because all individual fluid actuators 38 are healthy in this example, no fluid actuator replacement is performed. However, if individual fluid actuators 38 are not operating properly, this desired first print operation 50 may not be reproduced easily when considering a simple on-die nearest neighbor fluid actuator replacement when having fluid actuators 38 organized in two staggered columns across the center fluid-feed slot 52 as shown.

For instance, in the event of an "L" column fluid actuator 38 fault, it may be desirable that the replacement fluid actuator is as close to the vertical position of the faulted fluid actuator as possible. For instance, if fluid actuator "6" failed, shifting to fluid actuator "5" or "7" are the best candidates.

However, using these best candidate fluid actuators would require that the data for fluid actuator "6" be stored for 6 actuation events (due to the "N"=6 spacing) of column "L" and then shifted to fluid actuators "5" or "7". This approach thus requires at least 6 additional levels of fluid actuator data memory. In the event of an "R" column fluid actuator 38 fault say for fluid actuator "7", the best candidates would be fluid actuators "6" and "8" of the "L" column. In this situation, the printer device would have to pre-populate 6 actuation events worth of future print data to allow fluid actuators "6" or "8" to print in future of the original actuation event for fluid actuator "7". Because of this requirement for additional levels of fluid actuator data memory, autonomous on-die cross-slot fluid actuator replacement has not been commercially feasible. Hence, current solutions for "missing fluid actuator" or "faulted fluid actuator" fluid actuator replacement typically involve modifications to the upstream image pipeline in printer software so that replacement cross-slot fluid actuators are actuated in the appropriate time slots and thereby consequently not allowing for a mid-page/mid-print job immediate response for fluid actuator replacement.

Figure 4:
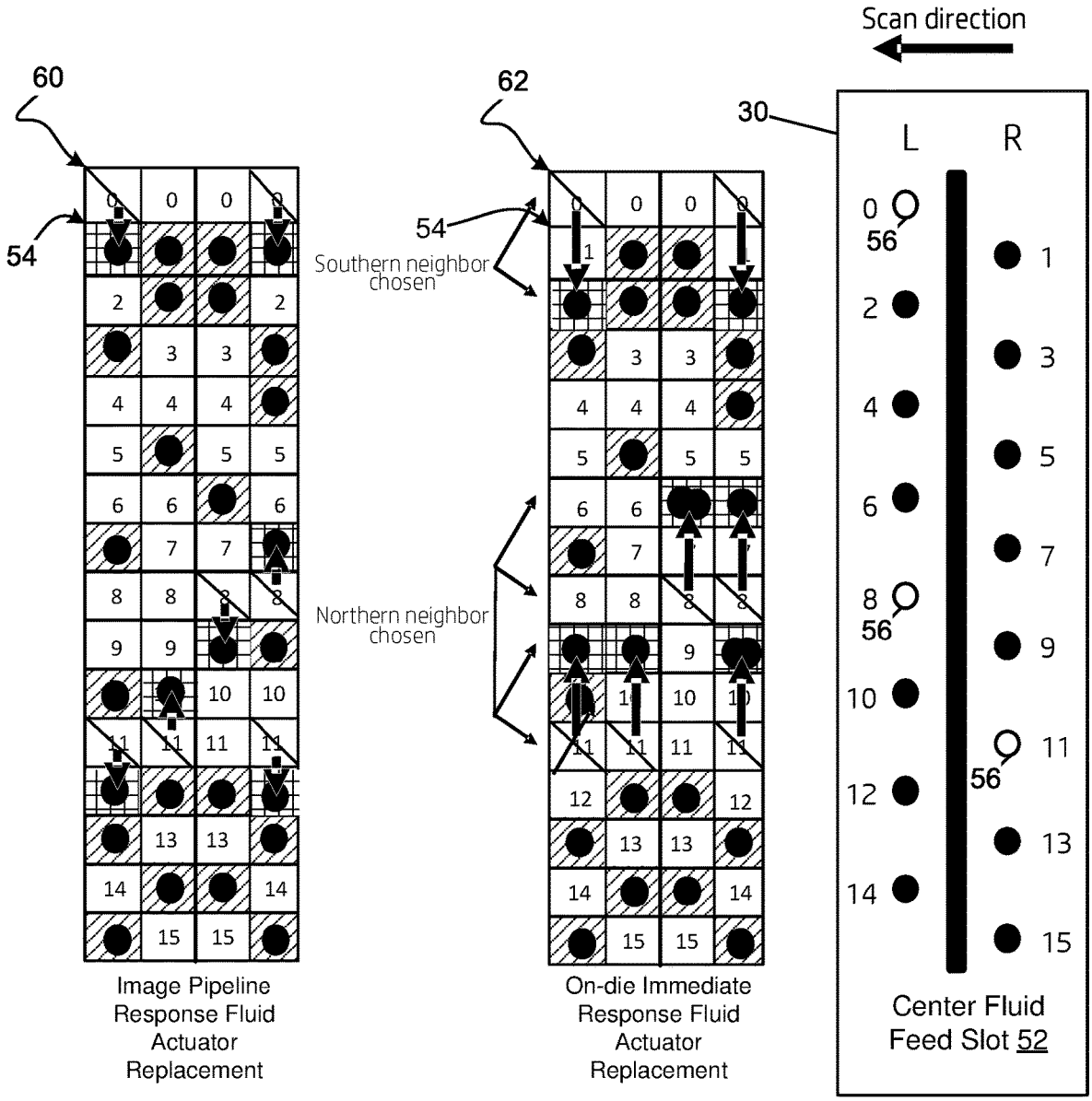
FIG. 4 is an illustration of an example pipeline response fluid actuator replacement print operation and an example on-die immediate response fluid actuator replacement print operation using an example fault-tolerant printhead.

FIG. 4 is an illustration of an example second print operation 60 with a software-based image pipeline response fluid actuator replacement and one example third print operation 62 using on-die immediate response fluid actuator replacement with an example fault-tolerant printhead 30 that has faulted fluid actuators 56 on fluid actuators "0", "8", and "11" illustrated as open dots. Example second print operation 60 is one example approach that the pipeline instructions 24 may use to replace fluid actuators upstream in the software image pipeline module by substituting an adjacent functional fluid actuator 38. First, the state of the fluid actuators is read from the fault-tolerant printhead 30 to determine locations of fluid actuators 38 with faults. The pipeline instructions 24 then calculates a set of print masks avoiding the use of the faulted fluid actuators and replacing their data at other adjacent fluid actuator locations. For instance, in locations "0", due to the faulted fluid actuator 38, the pipeline instructions 24 cause the data that was to be written to the far left and far right "0" locations to be moved to the vertical downward "1" locations. These locations are indicated by a squared-hashed fill. For faulted fluid actuator "8", the pipeline instructions 24 move the far-right actuate location to fluid actuator "7" and the center-right actuate location to fluid actuator "8" to preserve firing just one dot at each location. Similarly, for faulted fluid actuator "11", the far-left actuate location is moved to fluid actuator "12" below, and the far-right actuate location is moved downward to fluid actuator "12" as well. Other choices could have been made by the pipeline instructions 24 in reassigning the actuate data for the faulted fluid actuators 56 and the example shown is just for reference with the discussion of the on-die immediate response fluid actuator replacement third print operation 62.

In the on-die immediate response fluid actuator replacement third print operation 62, when an individual fluid actuator 38 is determined to have a fault during printing, the fault-tolerant printhead 30 may immediately re-direct firing print data for any faulted fluid actuators 56 to respective adjacent fluid actuators 38 in the same fluid actuator column or vertical dot row. This re-direction can occur autonomously without any interaction from the printer controller 10. This on-die immediate response fluid actuator replacement may not produce quite the same level of image quality as cross-column slot replacement as second print operation 60, but until the printer device 1 can implement an image pipeline fluid actuator replacement solution in the software image pipeline, this on-die in-column immediate replacement significantly reduces any image quality impact of continuing to actuate an individual fluid actuator 38 with a fault. Further, in some examples, such as when a resistor short is detected, the respective faulted fluid actuator 56 may be disabled and thus prevent cascading failures from further reducing the image quality impact of the print job and perhaps also extending the life of the fault-tolerant printhead 30 and printhead assembly 15.

Also, in some examples, depending on implementation on the fault-tolerant printhead 30, any fluid actuator redirection logic may choose between a north or south neighbor based on whether each of the north or south neighbors is firing. During an idle time, the per-fluid actuator memory 37 can be configured to be read by a processor 20 in the printer controller 10 to ascertain which fluid actuators are currently faulted and this information provided to the image pipeline module to allow the pipeline instructions 24 to improve image quality by avoiding the individual fluid actuators 38 with faults. Therefore, the autonomous immediate response fluid actuator replacement for those faulted fluid actuators 56 will no longer be necessary, but the on-die fluid actuator immediate response fluid actuator replacement for functioning individual fluid actuators 36 will continue to monitor, test, and redirect if any of those fluid actuators become faulted. Because some fluid actuator faults may be transient in nature or may be addressable by servicing the printhead assembly 15, during an idle time or after servicing, the printer device 1 may reset the fault sensors 36 and/or per-fluid actuator memory 37 and retest all individual fluid actuators 38 to determine if any previously compromised fluid actuators have recovered.

For instance, in on-die immediate fluid actuator replacement third print operation 62, the actuate data for fluid actuator "0" which is faulted is transferred autonomously to fluid actuator "2" which is the adjacent southern fluid actuator in the same column as fluid actuator "0", as there is no northern neighbor location. Further, in this example, the firing data for fluid actuator "8" which is faulted is transferred to northern adjacent locations on fluid actuator "6" which is functional. In this instance, the logic for the center-right fluid actuator "6" which actuate two times, once for its original data and again for the data transferred from fluid actuator "8". In another example, the on-die replacement could have monitored the firing data for fluid actuator "9" and noted that it was not set to actuate with data and transferred the fluid actuator "8" data to its southern adjacent neighbor. Similarly, for faulted fluid actuator "11", the firing data for fluid actuator "11" is transferred to its northern adjacent neighbor on fluid actuator "9", the far-right location "9" firing twice, once for its original data and the data transferred from location "11".

Figure 5:
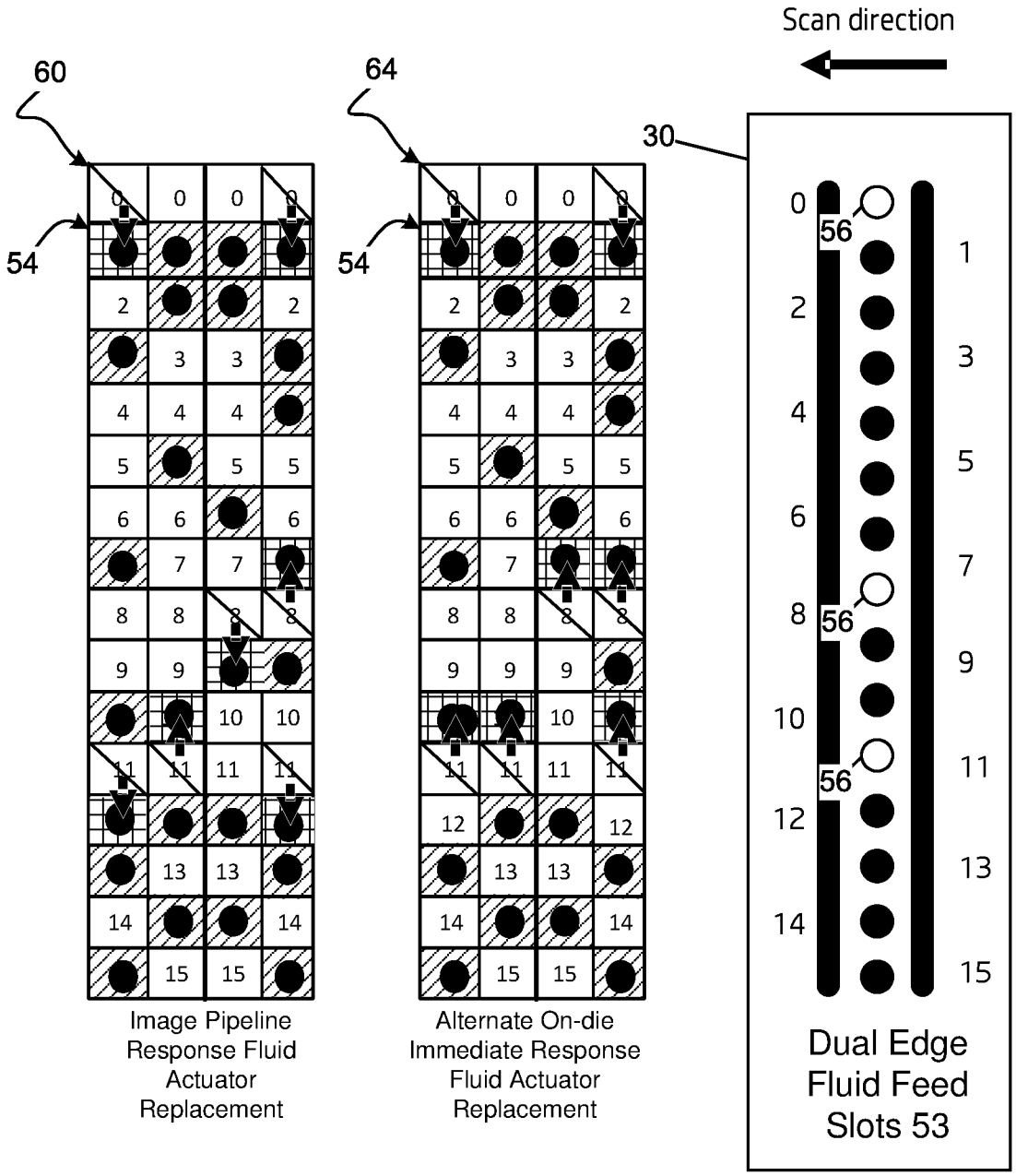
FIG. 5 is an illustration of an alternative example on-die immediate response fluid actuator replacement print operation using another example fault-tolerant printhead.

FIG. 5 is an illustration of an alternative example on-die replacement fourth print operation 64 with an alternative example fault-tolerant printhead 30. In this example, the individual fluid actuators 38 are placed in a single column with $1/1200^{th}$ separation (or different distance may be used) with dual edge fluid-feed slots 53 that help to prevent fluid displacement interaction when adjacent fluid actuators actuate. Because the individual fluid actuators 38 are all aligned in a single column, a closer approximation or a similar replacement may be implemented to simulate or replicate the software-based pipeline based fluid actuator replacement first print operation 60. In this simple example, column "0" has a southern adjacent neighbor replacement scheme selected and the other rows have a southern replacement adjacent neighbor scheme selected. More redirection logic may be used on-die to detect which nearest neighbors have no original actuate data and have the northern or southern adjacent transfer chosen based on surrounding adjacent actuate location original data or to minimize the number of drops actuated per location to prevent or minimize bleeding of the dots printed.

Further, the fault-tolerant printhead architecture may include circuitry to provide for other features which help in preventing waste of print media 4, ink, other fluids, or printhead assemblies 15. For instance, additional circuitry may allow for individual fluid actuators 38 with resistor-short faults to be disabled to prevent cascading failures and/or total printhead failure which may require a printhead assembly 15 to be replaced before resuming printing. In other examples, a fault sensor 36 may differentiate between a fully non-ejecting fluid actuator 38 and a compromised fluid actuator 38 (i.e. misdirection, weak fluid actuator, partially blocked, etc.). If a fluid actuator 38 is compromised, but still partially functional, the printer device 1 may decide to keep firing that fluid actuator 38 (because an in-column replacement would result in more dot placement error than continuing to use it), but at an idle time, scan it out so that the optimized image pipeline-based replacement can be realized. Further, a fault-tolerant printhead 30 may include a memory interface 32 to receive image pipeline data that avoids the use of individual fluid actuators 38 with faults to allow for a modified software-based image pipeline fluid actuator replacement solution. There may be multiple fault sensors 36 to be able to detect more than one type of fault per individual fluid actuator 38 and the per-fluid actuator memory 37 may have more than one type of fault status stored therein and readable by a printer controller 10. In some examples, to keep a printhead pin-count low, the fault-tolerant printhead 30 may have the per-fluid actuator memory 37 read out in a serial chain fashion of one or more bits of information. Further, after a printhead assembly 15 has been serviced, the fluid actuator sensors 36 and the per-fluid actuator memory 37 may be reset and the individual fluid actuators 38 retested to allow for the removal of fluid actuator faults which may have been corrected during servicing.

Figure 6:
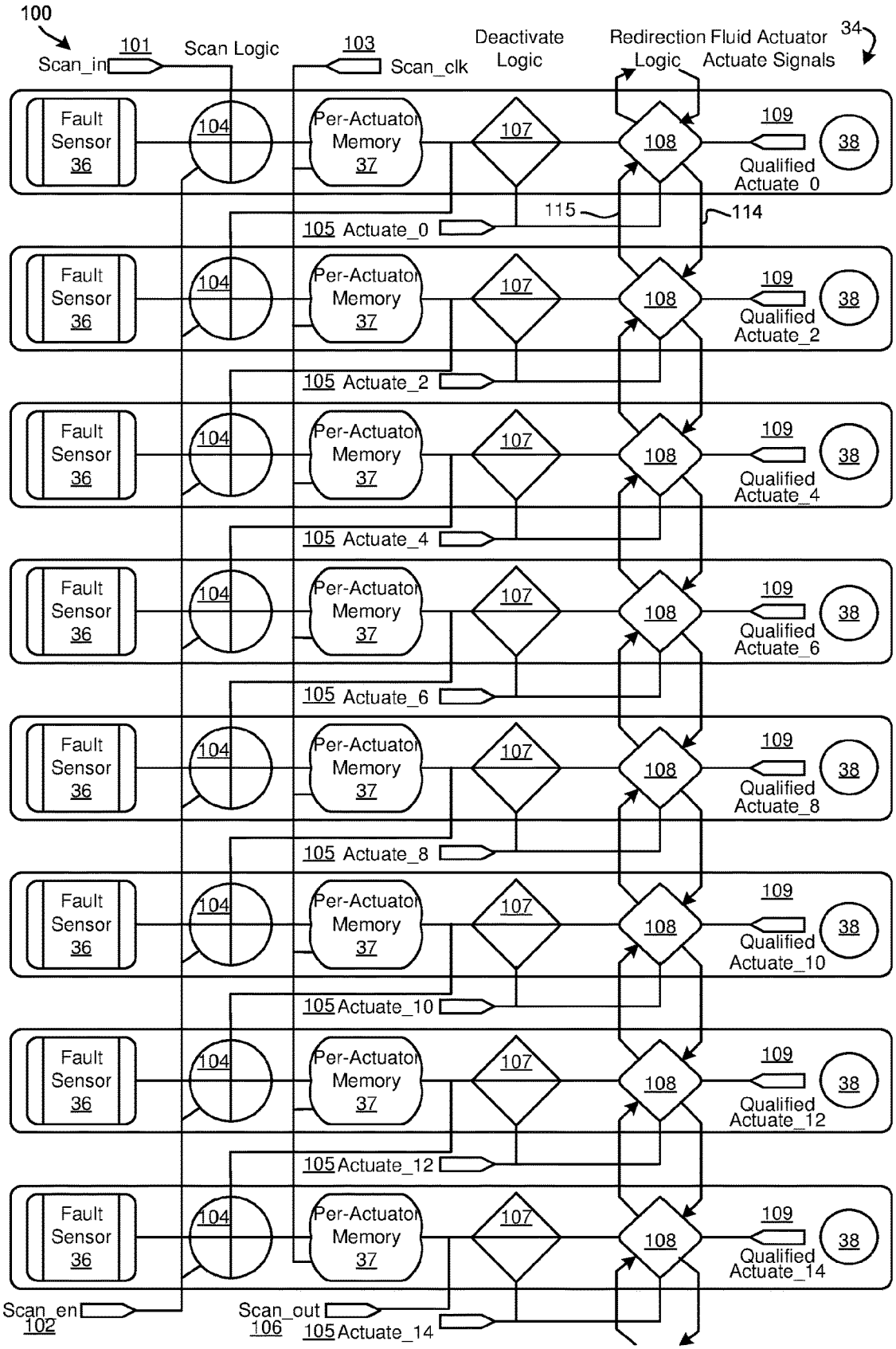
FIG. 6 is a functional schematic of an example fault-tolerant printhead.

FIG. 6 is a functional schematic diagram 100 of an example fault-tolerant printhead 30. Shown are eight fluid actuator-based cells of logic for a column of firing array of fluid actuators 34, here the even numbered individual fluid actuators 38 as shown in FIG. 4. A similar set of logic would be used for the odd numbered fluid actuators 38. A single fault sensor 36 may be provided at each fluid actuator location. In other examples, there may be one or more common or central fault sensors that monitor several fluid actuators and just the individual fluid actuator results passed to the fluid actuator fault sensor 36. The fault sensor 36 output is fed to scan logic 104. Scan logic 104 has a scan-enable (Scan_en) input 102 and a scan-clock (Scan_clk) 103. The scan-enable 102, when asserted, directs the adjacent per-fluid actuator memory 37 output to be fed to the output of the scan logic which is the input of the per-fluid actuator memory for the current fluid actuator cell. For the first fluid actuator cell (the top one), a scan-in (Scan_in) 101 signal is used to connect to other columns on the printhead or print cartridge to allow for a single serial chain. The scan-clock 103 when asserted causes the per-fluid actuator memory contents 37 to be transferred to the next fluid actuator cell and eventually all of the per-fluid actuator memory 37 status may be read by processor 20 at scan-out (Scan_out) 106 via memory interface 32 (FIG. 2). When scan-enable is not asserted, the contents of the fluid actuator cell fault sensor 36 is transferred to the per-fluid actuator memory 37 when scan-clock is enabled. The scan logic 104 may be implemented with multiplexers, transmission or digital gates, or other logic. The scan logic 104 may be discretely implemented or integrated with one or more of the other functional blocks. The per-fluid actuator memory 37 may be implemented using registers, flip-flops, dynamic or static memory circuits and the like.

In some examples, during a printing operation, the output of the per-fluid actuator memory 37 may be used as an input into deactivate logic 107 which also may receive the on-die firing signal (Actuate_N, where N=fluid actuator number) 105. For instance, if the per-fluid actuator memory 37 content has stored the state of the fault sensor 36, then if the fault is serious, such as a resistor short, the respective fluid actuator may be hardware deactivated to prevent cascading failures, such as due to overheating, metal migration, and/or trace openings, etc. For some faults, such as a decapped fluid actuator, the deactivate logic 107 may keep the fluid actuator active to allow for recovery before servicing or perhaps partial drop ejection which may help improve image quality. The deactivate logic may be implemented with one or more logic gates, state machines, or transistor logic as just some examples. It may also be discretely implemented or integrated with logic from other functional blocks.

The output of the deactivate logic in this example is fed to redirection logic 108 along with the on-die firing signal 105. In other examples, the output of the per-fluid actuator memory 37 may be fed directly into the redirection logic 108. Based on whether a cell is deactivated or the per-fluid actuator memory output is in another state, the redirection logic 108 can transfer the on-die firing signal 105 to northern or southern neighbors. The top and bottom fluid actuator cells may allow for input and outputs to "northern" or "southern" fluid actuators on separate adjacent fault-tolerant printheads 30 on a multi-printhead print cartridge. The state of the adjacent cell firing data may be used to determine whether the "northern" or "southern" transfer is to occur. In other examples, the "northern" or "southern" assignment may be hard coded in the wiring of the fault-tolerant printhead 30 integrated circuit. The output of the redirect logic 108 results in a qualified actuate (Qualified Actuate_N) signal 109. If the fluid actuator has been deactivated, the qualified actuate signal 109 will not actuate for the deactivated fluid actuator. However, for some faults, such as a decapped fluid actuator, the on-die actuate signal may be both rerouted to an adjacent fluid actuator as well as allowed to actuate the fluid actuator with a fault in hopes of recovering the fluid actuator while at the same time taking precautionary corrective action to improve image quality should the fluid actuator not recover. The redirection logic may be implemented using a variety of digital logic, state machines, transmission gates, switches, simple wiring, and the like.

Figure 7:
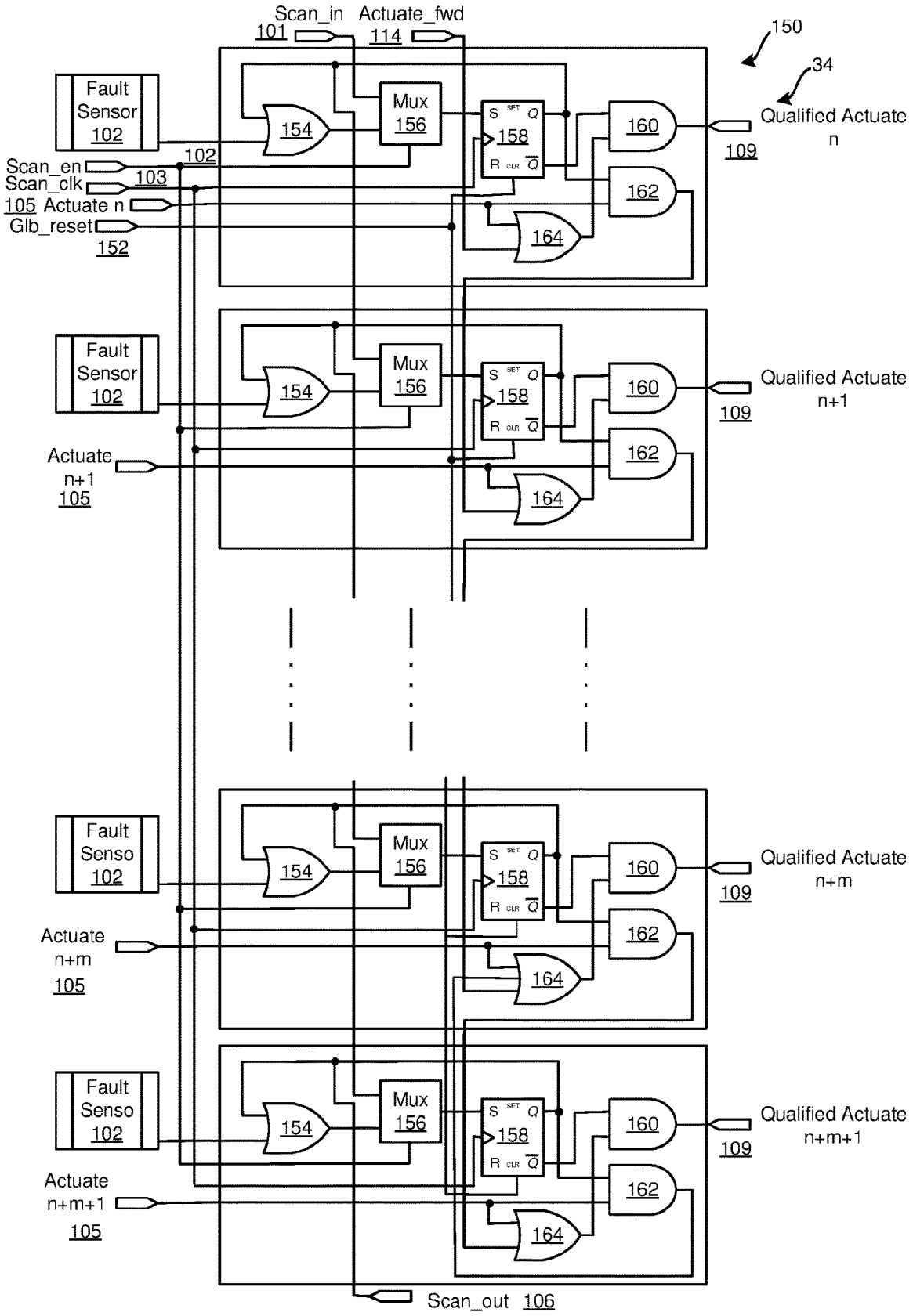
FIG. 7 is a partial logic schematic of an example fault-tolerant printhead.

FIG. 7 is a partial logic schematic 150 of one example fault-tolerant printhead 30 illustrating one possible simple implementation to demonstrate the functionality of an array of fluid actuators 34. Many other different logic combinations are possible for implementing a fault-tolerant printhead 30 and the following example is merely for illustration of the principles and is not meant to be limiting of the claimed subject matter.

The scan logic 104 is implemented by mux 156 and register 158. When scan enable 110 is enabled, mux 156 selects either scan in 101 or the output of the previous register 158 depending on the fluid actuator cell location.

Also, when scan-enable 110 is enabled, each scan-clock 103 causes a serial chain of the per-fluid actuator memory 37 to be "bit-bucket brigaded" or serialized to the scan-out 106 output. The scan-out 106 output may be coupled to the memory interface 32 or coupled to another column on the same or different fault-tolerant printhead 30. When scan-enable 110 is not enabled, the output of the fault sensor 36 is fed to a first OR gate 154 and its output is selected by the mux 156 to be fed into register 158 when scan-clock 103 is triggered during a printing operation to sample the output of fault sensor 36. The first OR gate 154 allows for latching a sensed fault from fault sensor 36. The per-fluid actuator memory 37 in this example is implemented by first OR gate 154 and register 158 along with the scan-clock 103 and global reset (Glb_reset) 152 signals used to capture and reset the per-fluid actuator memory 37. A second OR gate 164, first NAND gate 160, and second NAND gate 162 implement both the redirection logic 108 and the deactivate logic 107 along with the Q and Qbar outputs of the register 158. If a fault is detected and stored in register 158, then the Qbar output is low and this disables or deactivates the qualified Actuate_N signal 109. Also, the previous actuate forward (Actuate_fwd) 114 or output of the second NAND gate 162 of the previous fluid actuator cell is combined with the current cell on-die actuate N signal 105 which is fed to first NAND gate 160. If a fault has been detected, then the Q output of register 158 is enabled and allows the on-die actuate N signal 105 for the current fluid actuator cell to be forwarded to the "southern" neighbor fluid actuator cell via the output of second NAND gate 162.

In this example, all but the last bottom cells are hardwired to perform a "southern" neighbor transfer. As the last bottom cell has no southern neighbor, it is hardwired to transfer to its "northern" neighbor cell. In other examples, if multiple fault-tolerant printheads 30 are used and placed adjacently, the output may instead be routed to a pin that allows coupling to the "southern" cell neighbor of the adjacent fault-tolerant printhead 30.

Figure 8A:
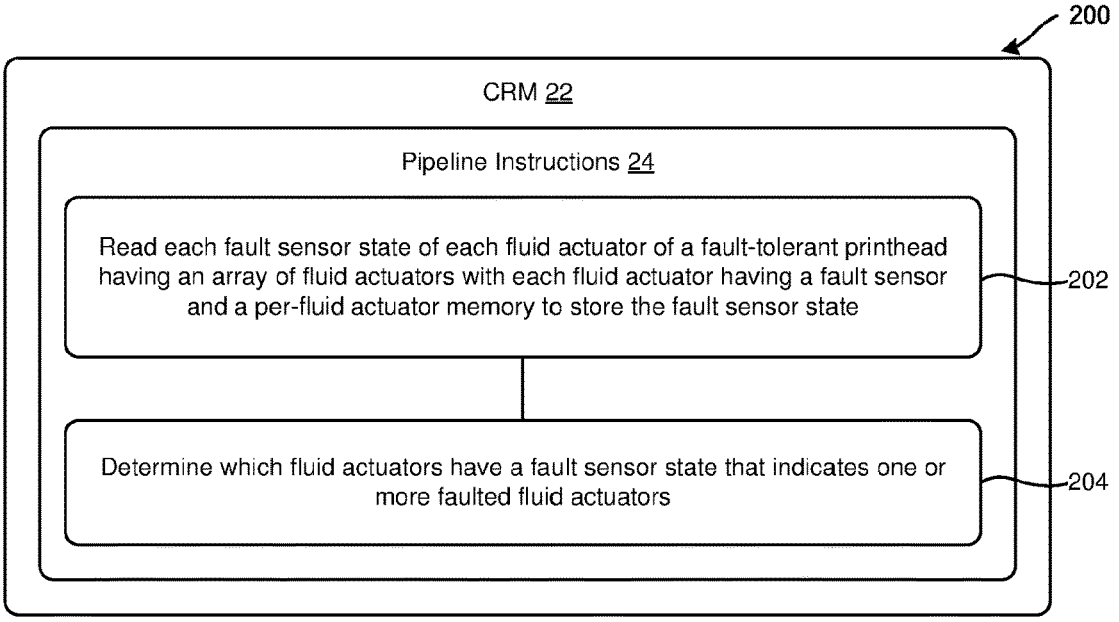
FIGS. 8A and 8B are block diagrams of example pipeline instructions for using example fault-tolerant printheads.
Figure 8B:
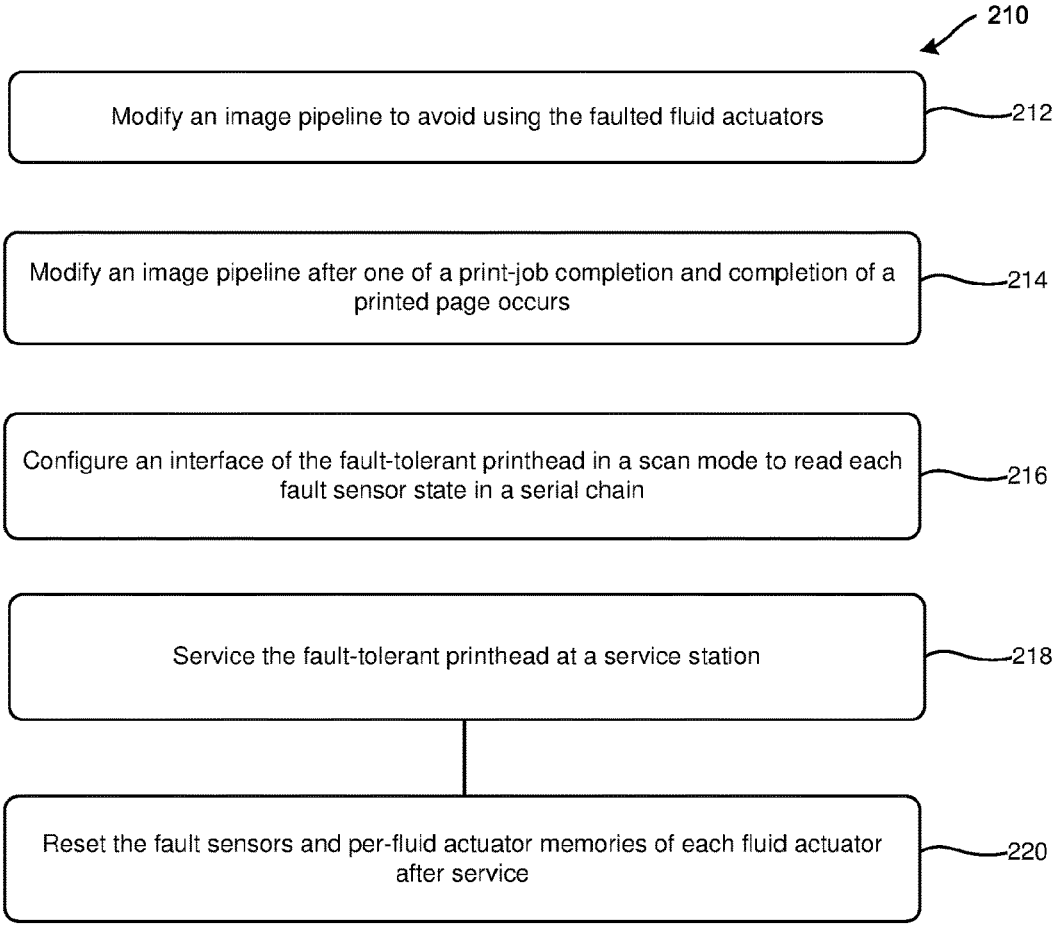

FIGS. 8A and 8B are block diagrams 200 and 210 respectively of example pipeline instructions 24 (FIG. 2) for using one or more example fault-tolerant printheads 30. Pipeline instructions 24 reside on a computer readable medium 22 that is readable by a processor 20 which executes the pipeline instructions 24. In block 202, each fault sensor state of each fluid actuator 38 is read from a fault-tolerant printhead 30 having an array of fluid actuators 34 with each fluid actuator 38 having a fault sensor 36 and a per-fluid actuator memory 37 to store the fault sensor state. In step 204, fluid actuators 38 that have a fault sensor state that indicates one or more faulted fluid actuators are determined. Accordingly, the fault-tolerant printhead 30 has on-die fluid actuator sensors that detect the functional state of each fluid actuator and a processor 20 can read which of the fluid actuators 38 have faults and provide that information to an image pipeline module.

In block diagram 210, there are additional pipeline instructions 24 which may reside on the computer readable medium 22 for execution on processor 20 when read. In block 212, an image pipeline may be modified to avoid using individual fluid actuators 38 that are determined to have faults and thus are faulted fluid actuators. In block 214, the image pipeline may be modified after one of a print-job completion and completion of a printed page occurs. As noted, multiple print-jobs may be completed on a single piece of continuous media and the modification of the image pipeline may occur between print-jobs without performing a separation of the media and thus the media may be continuous. In block 216, a memory interface 32 of the fault-tolerant printhead 30 may be configured into a scan mode to read each fault sensor state in a serial chain. In other examples, the fluid actuators 38 of the printhead may be individually addressed and read in a random-access fashion using one or more bits of data per address. In block 218 the pipeline instructions 24 may include further instructions to service the fault-tolerant printhead 30 at a service station in the printer device 1. In block 220, the fault sensors 36 and the per-fluid actuator memories 37 of each individual fluid actuator 38 may be reset after service. The reset may be global or individual fluid actuator or fluid actuator groups resettable.

Figure 9:
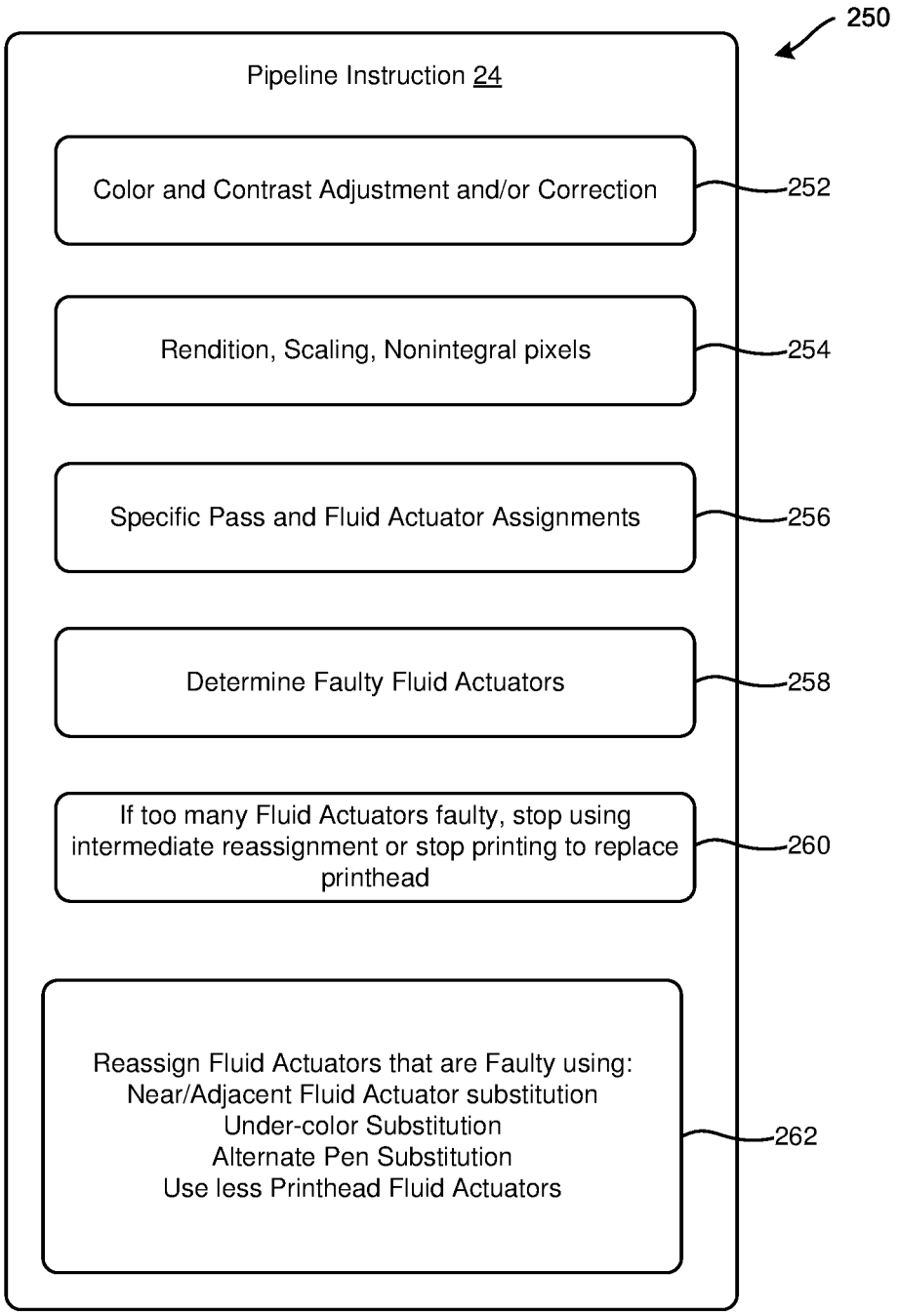
FIG. 9 is a block diagram of additional example pipeline instructions for an example image pipeline module using the fault-tolerant printhead.

FIG. 9 is a block diagram 250 of additional example pipeline instructions 24 for an example image pipeline module using the fault-tolerant printhead 30. For example, the pipeline instructions 24 may include color and contrast adjustment and/or correction as in block 252. In block 254, other instructions may allow for rendition, scaling, and nonintegral pixel manipulation. In block 256, the instructions may create specific printhead pass and fluid actuator assignments. In block 258, the instructions may read the fault-tolerant printhead 30 to determine which individual fluid actuators 38 have been declared faulted and if so, what particular faults have been detected. In block 260, if too many individual fluid actuators 38 are detected as faulted, then the on-die intermediate reassignment of individual fluid actuators 38 may be stopped from being used or the printing job may be stopped to allow for replacement of the fault-tolerant printhead 30. The number of individual fluid actuators 38 with faults that are "too many" may differ depending on if the fluid actuators with faults are consecutive in order or distributed across the fault-tolerant printhead 30. In block 260, assuming there are not too many fluid actuators faulty, the individual fluid actuators 38 that are faulty are reassigned using one of several possible substitution approaches. For instance, a near/adjacent fluid actuator substitution may be used, particularly when the print-job is of a single primary pen color (such as Magenta, Cyan, Yellow, and Black). In other examples where multiple colors are used, there may be under-color substitution or alternative printhead assembly 15 substitution. In some examples, if several failed fluid actuators 56 are consecutive and located near ends of the printhead die 31, it may be possible to use less printhead fluid actuators than the total number of printhead fluid actuators on the printhead. That is, just a consecutive sequence of functional individual fluid actuators 38 is used and more scans of the fault-tolerant printhead 30 are needed to account for fewer available fluid actuators for a single pass printing session.

Figure 10:
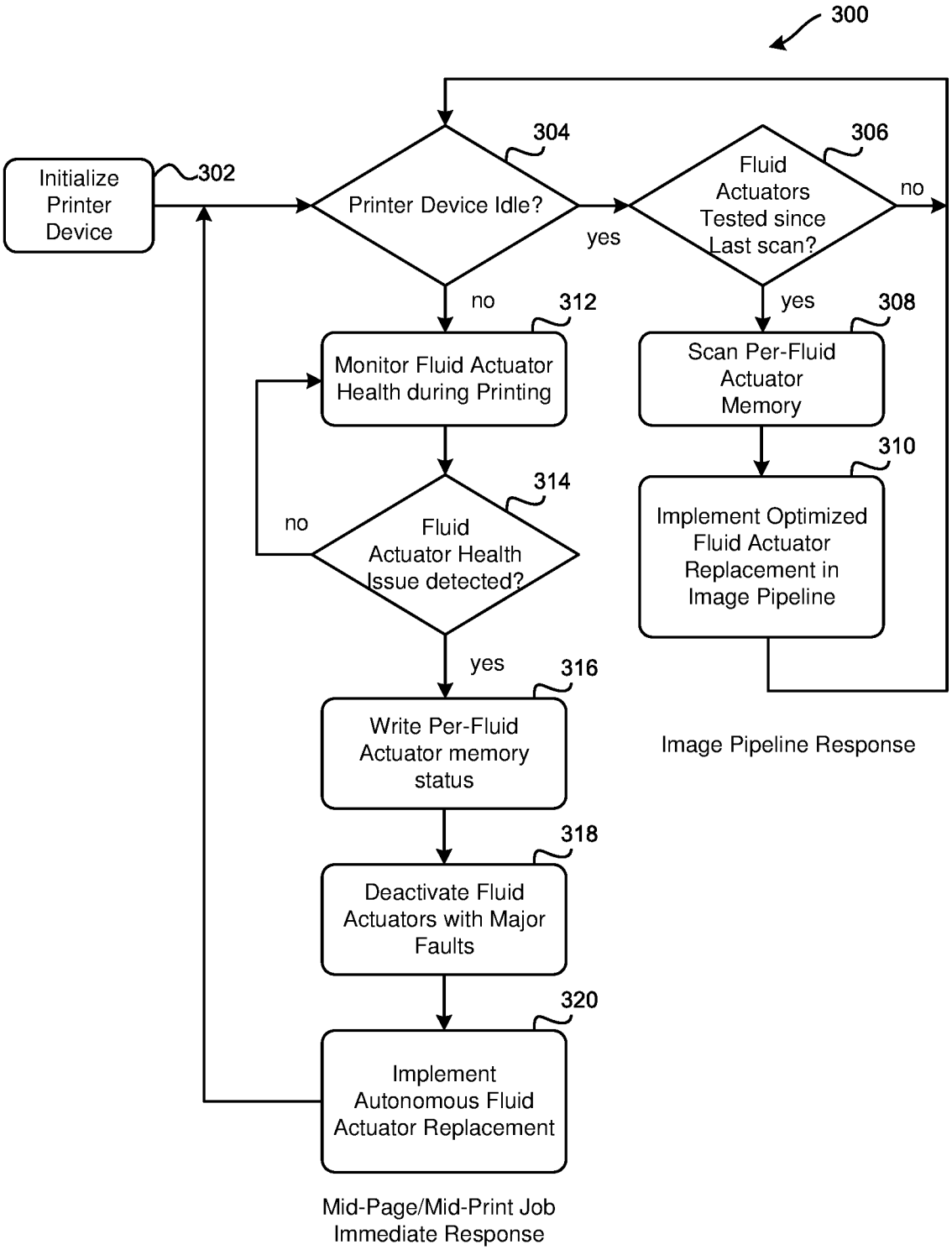
FIG. 10 is an example flowchart of operating a printer with an example fault-tolerant printhead to allow for both an immediate and image pipeline fluid actuator replacement response.

FIG. 10 is an example flowchart 300 of operating a printer device 1 with one or more example fault-tolerant printheads 30. In block 302, the printer device 1 is initialized prior to print jobs to establish communications with host computers via networks or other com channels. Other printer initialization operations may include adjusting and advancing a media feed mechanism, priming and moving any printheads, initializing memory or other job storage areas, and the like. After the printer device 1 is initialized in block 302 then in block 304, the printer device 1 is checked to see if the printer controller 10 is in an idle state. If so, then in block 306, the printer controller 10 checks to see if the fluid actuators 38 have been tested since the last scan of the printhead(s) across the print medium 4. If not, then flow returns to decision block 304. If the fluid actuators 38 have been tested, then in block 308 a scan of per-fluid actuator memory 37 is performed to read and detect any fluid actuators 38 with faults.

In block 310, the results of the per-fluid actuator memory scan are passed within the pipeline instructions to implement optimized fluid actuator replacement upstream in the software image pipeline rather than using on-die immediate response fluid actuator replacement.

Going back to decision block 304, if the printer device 1 is not in an idle state, then in block 312, the health of fluid actuators 38 are monitored during printing using on-die fault sensors 36 and in decision block 314 determine if a health issue is detected. If not, flow returns to block 312 to continue monitoring the health of the fluid actuators 38. If a health issue is detected, then in block 316, the status of the respective fault sensor 36 is written to a per-fluid actuator memory 37 for the associated fluid actuator 38. In some implementations or based on what the health issue detected is, in block 318 the fluid actuators 38 with major faults such as resistor shorts are deactivated to prevent cascading failures. In block 320, the on-die autonomous fluid actuator replacement is implemented for the fluid actuators 38 with faults for a mid-page/mid-print job immediate response and flow returns to decision block 304 to check if the printer device 1 is idle and if so have the fluid actuator replacement response implemented by the software image pipeline.

In summary, a method and system related to on-die fluid actuator failure detection and replacement have been disclosed. The printer device 1 may include a fault-tolerant printhead 30 that can sense faulty fluid actuators and/or bad ejection elements, such as resistors or piezo ejectors. The fault-tolerant printhead 30 may be used in one or more printhead assemblies 15 in the printer device 1. The fault-tolerant printhead 30 includes per-fluid actuator memory to store the status of individual fluid actuators 38. It may also include logic to autonomously disable or replace faulted fluid actuators 56. A printer controller 10 may allow for both a mid-page/mid-print job immediate response to fluid actuator replacement by allowing the fault-tolerant printhead 30 to autonomously provide the fluid actuator replacement. When the printer controller 10 detects an idle state of printer device 1, the pipeline instructions may read the contents of per-fluid actuator memory that records the status of individual fluid actuators 36. Any faulted fluid actuators 56 that have been detected may be noted and a software image pipeline routine updated to mitigate the effects of the faulted fluid actuators.

While the claimed subject matter has been particularly shown and described with reference to the foregoing examples, those skilled in the art will understand that many variations may be made therein without departing from the intended scope of subject matter in the following claims. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A device comprising:

a computer readable medium including instructions to create an image pipeline;

a processor coupled to the computer readable medium to execute the instructions;

a fault-tolerant printhead having on-die autonomous fluid actuator replacement capability and including:

an array of fluid actuators, each fluid actuator further comprising:

a fault sensor to detect a respective fluid actuator with a fault;

a per-fluid actuator memory to store a fault sensor state of the respective fluid actuator;

deactivate logic to disable the respective fluid actuator if faulted;

redirection logic to autonomously assign data in the image pipeline directed towards the respective fluid actuator immediately to a respective adjacent replacement fluid actuator; and an interface coupled to the processor to read the state of each per-fluid actuator memory, wherein the instructions are to enable modification of an operation of the device based on the read state of each per-fluid actuator memory, wherein the modification of the operation comprises on-die autonomous fluid actuator replacement, and wherein the deactivate logic and the redirection logic each act autonomously without intervention by the processor.

2. The device of claim L wherein the modification of the operation comprises modification of an image pipeline to mitigate the effects of any fluid actuators with faults.

3. The device of claim 1, further comprising a servicing station for the fault-tolerant printhead, the computer readable medium further including instructions to:

service the fault-tolerant printhead using the servicing station; and reset the fault sensors and per-fluid actuator memories of each fluid actuator after service.

4. A fault-tolerant printhead comprising:

an array of fluid actuators, each fluid actuator further comprising:

a fault sensor to detect a faulted fluid actuator;

a per-fluid actuator memory to store a fault sensor state of the fluid actuator;

deactivate logic to disable the faulted fluid actuator;

redirection logic to autonomously assign data directed to the faulted fluid actuator immediately to a respective adjacent replacement fluid actuator; and an interface to read the state of each per-fluid actuator memory, wherein the deactivate logic and the redirection logic each act autonomously without intervention by a processor that provides the data to the fault-tolerant printhead, the fault-tolerant printhead having on-die autonomous fluid actuator replacement capability.

5. The fault-tolerant printhead of claim 4, wherein the per-fluid actuator memory is to store multiple fault sensor states of the respective fluid actuator.

6. The fault-tolerant printhead of claim 4, wherein the interface is to allow permit reading the fault sensor state of the array of fluid actuators in a serial chain.

* * * * *